US006893219B2

(12) United States Patent
Conti

(10) Patent No.: US 6,893,219 B2
(45) Date of Patent: May 17, 2005

(54) TWO-STAGE PUMP WITH HIGH HEAD AND LOW DELIVERY

(75) Inventor: Carlo Conti, Osnago (IT)

(73) Assignee: Finder Pompe S.p.A, Merate (LC) (IT)

( * ) Notice: Subject to any disclaimer, the term of this patent is extended or adjusted under 35 U.S.C. 154(b) by 34 days.

(21) Appl. No.: 10/690,058

(22) Filed: Oct. 21, 2003

(65) Prior Publication Data

US 2004/0086393 A1 May 6, 2004

(30) Foreign Application Priority Data

Oct. 28, 2002 (IT) ..... MI2002A2288

(51) Int. Cl.[7] ..... F04D 29/28

(52) U.S. Cl. ..... 415/199.1; 415/206; 416/198 R; 417/423.5

(58) Field of Search ..... 415/199.1, 206; 416/198 R; 417/423.1, 423.5

(56) References Cited

U.S. PATENT DOCUMENTS 3,825,366 A * 7/1974 Herrick ..... 415/199.1
3,934,752 A * 1/1976 Ravicchio et al. ..... 415/199.1
5,320,489 A * 6/1994 McKenna ..... 415/199.1

* cited by examiner

*Primary Examiner*—Edward K. Look
*Assistant Examiner*—Igor Kershteyn
(74) *Attorney, Agent, or Firm*—Timothy J. Keefer; Seyfarth Shaw LLP

(57) ABSTRACT

A pump includes a body, an actuating shaft, on which at least a first impeller and a second impeller are axially mounted, a fluid intake duct and a fluid delivery duct. The pump further includes front and rear chambers, first and second volutes, first and second discharge orifices and a channel inside the body for throughflow of fluid to the second impeller.

14 Claims, 2 Drawing Sheets

TWO-STAGE PUMP WITH HIGH HEAD AND LOW DELIVERY

CROSS REFERENCE TO RELATED APPLICATION

This application is based on and claims the priority of Italian Application No. M12002A 002288, filed on Oct. 28, 2002.

In the sector in question particular types of pump (called PEP, i.e. Partial Emission Pumps) are known, said pumps having the characteristics of a high head and low delivery and being of the type where a fluid, contained in a tank and subject to the pressure determined by the fluid column, enters into the pump in an axial direction and is pushed by the impeller towards the delivery duct arranged in a tangential direction and having dimensions such as to determine the required head of the pump.

It is also known that, in order to be able to increase the head of the pump, it is possible to modify only the number of revolutions of the impeller which, consequently, must be designed with a special form able to ensure that the inlet pressure is maintained; otherwise, the increase in the number of revolutions would result in a reduction in the inlet pressure and consequently a reduced intake of fluid with a consequent decrease in the efficiency of the pump; this effect is even more marked in those cases where the pump is arranged at a level higher than that of the free surface of the fluid to be drawn.

In order to overcome this drawback, high-speed pumps have been designed, of the type provided with a fast main impeller able to increase substantially the head and an auxiliary impeller arranged upstream of the first impeller and able to supply the main impeller without a substantial loss in suction of the fluid at the inlet and without affecting the increase in the delivery pressure of the pump.

These pumps, however, are complicated and costly to manufacture and moreover require special parts with a limited degree of standardization.

The technical problem which is posed, therefore, is that of designing pumps which are able to operate within a wide range of low delivery values and with a high head, without being affected by the abovementioned problems of the existing art.

Within the context of this problem a further requirement is that the pump should have compact dimensions and have high interchangeability characteristics, namely should allow variation in the rated delivery within a wide range of operating values, with minimum modifications which do not involve the general structure of the pump and allow the largest possible number of components to be standardized, reducing in this way the storage requirements and consequently the production and management costs.

These results are obtained according to the present invention by a pump comprising a body, an actuating shaft, on which at least a first impeller and a second impeller are coaxially mounted, each being housed in a respective front chamber and rear chamber respectively connected to a fluid intake duct and a fluid delivery duct, in which said front chamber is delimited by said body and by an interstage body, said rear chamber is delimited by said interstage body and by a shield, said interstage body has two volutes respectively associated with the corresponding first impeller and second impeller, a first discharge orifice connecting the volute of the first impeller to the exterior, a second discharge orifice connecting the volute of the second impeller to the delivery duct, inside said body there being formed a channel for the throughflow of the fluid from said first chamber to the means for supplying the fluid to the second impeller.

Further details may be obtained from the following description of a non-limiting example of embodiment of the subject of the present invention provided with reference to the accompanying drawings, in which.

Figure 1:
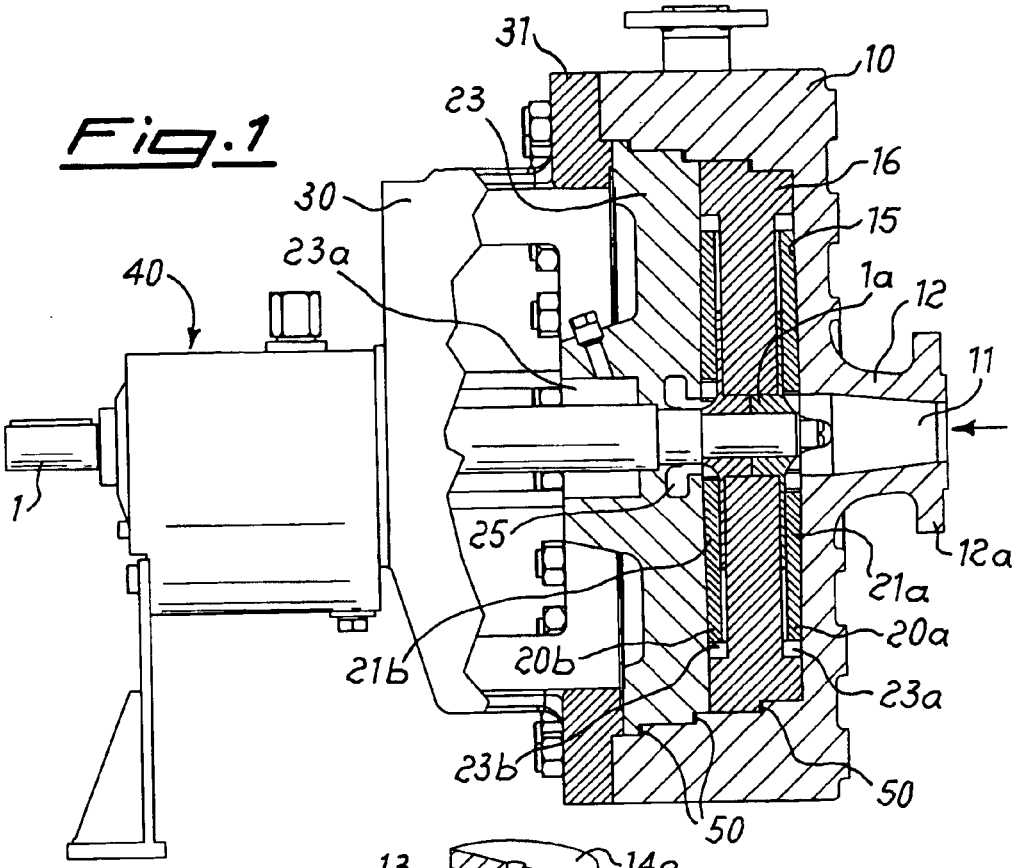
FIG. 1 shows a partially sectioned schematic perspective view of the pump according to the present invention.

As shown in FIG. 1, the pump according to the present invention comprises a body 10 with which the duct 11 for axial entry of the fluid is associated; said duct 11 is formed inside a coaxial extension 12 provided with a flange 12*a* for frontal coupling with the supply apparatus.

For the sake of convenience of description said part corresponding to the body 10 of the pump and to the fluid inlet will be defined below as "front", while the opposite side will be defined as "rear".

Said front body 10 also contains the fluid delivery duct 13 which extends in a direction tangential to the said body 10 inside a corresponding extension 14 with which an associated coupling flange 14*a* is integral.

A suitable annular seat 15 is formed in the body 10 and has, arranged therein, a coaxial interstage body 16 through which the pump actuating shaft 1 passes via a bush 1*a*.

Said interstage body 16 essentially divides the annular seat 15 into a first front chamber 15*a* and into a second rear chamber 15*b*; inside these chambers a first impeller 21*a* and a second impeller 21*b* respectively rotate, being both mounted on the said actuating shaft 1; said impellers are identical, symmetrical and opposite to each other.

Said chambers 15*a*, 15*b* communicate with the exterior by means of respective volutes 22*a* and 22*b* which, in a preferred embodiment, are of the annular type, have a constant cross-section and have discharge nozzles 16*a*, 16*b* which are angularly offset at 180° with respect to each other.

Figure 2:
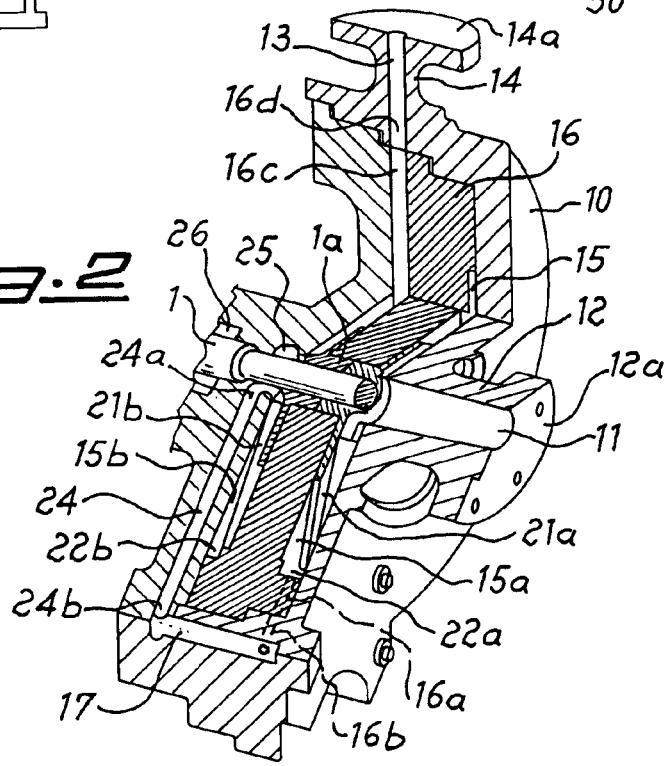
FIG. 2 shows a partially sectioned schematic perspective view of the pump according to FIG. 1.
Figure 3:
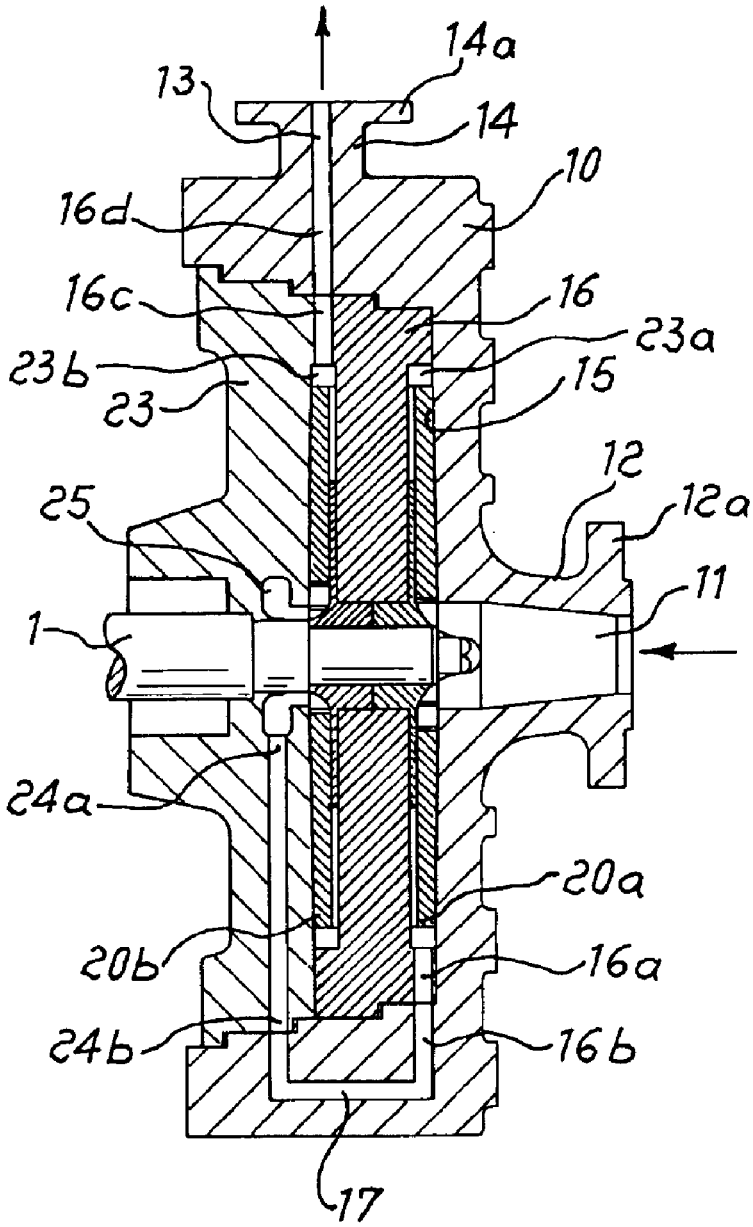
FIG. 3 shows a schematic cross-section through the pump according to FIG. 1.

Said second chamber 15*b* is closed at the rear and axially closed by a shield 23 inside which (FIGS. 2 and 3) a radial duct 24 is formed; one external end 24*b* of said duct is connected to a channel 17 which is parallel to the longitudinal axis of the pump and formed in the front body 10 thereof and the other internal end 24*a* is connected to a coaxial annular header 25 which emerges coaxially in said rear chamber 15*b*.

The front chamber 15*a* is connected to the said axial duct 17 of the body 10 by means of a volute 22*a*, the said discharge nozzle 16*a* formed in the interstage body 16 and arranged in a tangential direction, and a radial duct 16*c*; the rear chamber 15*b* is in turn connected to the tangential delivery duct 13 by means of the volute 22*b*, the associated discharge nozzle 16*c* formed in a tangential direction in the interstage body 16 and a corresponding radial duct 16*d* formed in the body 10 of the pump.

The shield 23 also has a coaxially extending seat 23*a* in which it is possible to mount all the sealing devices on the shaft, whereby the possibility of installing magnetic-coupling drive devices necessary for highly dangerous, radioactive and similar fluids is also envisaged.

The pump is closed at the rear by a casing 30 acted on by a flange 31 which ensures clamping of the shield 23 and the interstage body 16 in the axial direction.

The supports 40 of the shaft 1 are fastened on the other side of the casing 30. Said parts of the pump are conventional per se and therefore not described in detail.

The operating principle of the pump is as follows:

the fluid which enters via the intake duct 11 reaches the first chamber 15*a* where it is subjected to the action of the first impeller 21*a* which pushes it into the volute 22*a* and from here into the duct 16*a*,16*b* for connection to the channel 17 which emerges in the radial duct 24 of the shield 23;

along this first travel path the fluid undergoes the first increase in pressure with respect to the intake pressure;

upon leaving the radial duct 24 the fluid is forced inside the annular header 25 which arranges it in the axial direction for entry into the second chamber 15*b* where it is subjected to the action of the second impeller 21*b* which forces it into the volute 22*b* and from here into the radial duct 16*c*,16*d* and then into the delivery duct 13 with a further increased pressure.

It is pointed out therefore how the two impellers and the associated concentric volutes produce a series action on the fluid able to increase its head (typical values of up to 200 m of liquid column) without an increase in the number of revolutions of the impellers and therefore without a reduction in the intake characteristics of the pump which may continue operating close to the point of maximum efficiency with advantages in terms of energy and fluid dynamics.

In addition to this, the pump according to the invention allows a high degree of interchangeability since it is possible to vary the rated delivery of the pump (typical values ranging from 1 to 18 $m^3/h$) by simply changing the interstage body 16 and keeping unchanged the configuration and the dimensions of the other parts of the pump, which also has a rotating part which, owing to the symmetry and opposite positioning of the impellers and the arrangement of the nozzles of the two volutes at 180°, is substantially free from the effect of radial and/or axial loads with a consequent increased structural rigidity which favours the working life of the sealing parts and the parts subject to wear, increasing the reliability of the pump.

The pump according to the invention has moreover an extremely compact design among other things owing to the formation, inside the body, of the duct connecting the two stages, avoiding the excessively large dimensions resulting from the external connection channels of the conventional type.

It is pointed out moreover how the pump body 10 has a configuration of the housing in the form of a radially divided "barrel" with flanged intake and delivery openings having the function of withstanding the rated pressure and housing the two impellers and the interstage body containing the two concentric volutes with respective diffusion channels and the rear shield inside which the radial interstage connection channel, the intake header and the chamber housing the shaft sealing device are formed.

In a preferred embodiment it is envisaged that the seal between the body 10 and the shield 23 and the seal between the zones subject to the differential pressures of the first and second stage consist of seals 50 of the spiralled metallic type, made on the one hand of steel and on the other hand of graphite and able also to take up any play resulting from the mating or thermal expansion and/or contraction of the various parts.

What is claimed:

1. A pump comprising a body, an actuating shaft, on which at least a first impeller and a second impeller are coaxially mounted, said first impeller being housed in a front chamber and said second impeller being housed in a rear chamber, the rear chamber connected to a fluid intake duct and a fluid delivery duct, wherein said front chamber is delimited by said body and by an interstage body;

said rear chamber is delimited by said interstage body and by a shield wherein said interstage body comprises:

a first volute associated with the first impeller and a second volute associated with the second impeller;

a first discharge orifice associated with the first volute;

a second discharge orifice connecting the second volute to the delivery duct; and wherein said body comprises a channel for throughflow of fluid from said front chamber to a means for supplying the fluid to the second impeller.

2. The pump according to claim 1, wherein said channel of the body is arranged parallel to a longitudinal axis of the pump.

3. The pump according to claim 1, wherein said first and second discharge orifices of the first and second volutes are arranged in a tangential direction.

4. The pump according to claim 1, wherein said first orifice for connecting the first volute to said channel of the body is connected to a first radial duct formed in said body.

5. The pump according to claim 1, wherein said means for supplying the fluid to the second impeller comprises a radial duct inside the shield, and wherein opposite ends of said radial duct are respectively connected to the channel of the body and to a header for supplying fluid to the second chamber.

6. The pump according to claim 4, wherein said header supplying the fluid to the second chamber has a coaxially extending nozzle for supplying the fluid to the second impeller in an axial direction.

7. The pump according to claim 4, wherein said discharge orifice of the second volute is connected to the fluid delivery duct by means of a second radial duct formed in the said pump body.

8. The pump according to claim 1, wherein said interstage body is interchangeable.

9. The pump according to claim 1, wherein the first and second volutes are annular.

10. The pump according to claim 1, wherein the first and second volutes have a constant width.

11. The pump according to claim 1, wherein the first and second volutes comprise discharge nozzles, the discharge nozzles being angularly offset at 180° with respect to each other.

12. The pump according to claim 1, wherein said first and second impellers are identical, symmetrical and opposite to each other.

13. The pump according to claim 1, further comprising one or more seals between the interstage body and the pump body and between the rear shield and the pump body, wherein the seals are of the spiral type.

14. The pump according to claim 13, wherein said seals are made of steel and graphite.

* * * * *